US006681450B2

(12) United States Patent
Pferdmenges et al.

(10) Patent No.: US 6,681,450 B2
(45) Date of Patent: Jan. 27, 2004

(54) APPARATUS FOR REGULATING FIBER TUFT QUANTITIES SUPPLIED TO A CARDING MACHINE

(75) Inventors: Gerd Pferdmenges, Jüchen (DE); Robert Többen, Mönchengladbach (DE)

(73) Assignee: Trutzschler GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/139,339

(22) Filed: May 7, 2002

(65) Prior Publication Data

US 2002/0124354 A1 Sep. 12, 2002

Related U.S. Application Data

(63) Continuation of application No. 10/021,305, filed on Dec. 19, 2001.

(30) Foreign Application Priority Data

Dec. 22, 2000 (DE) ..... 100 64 655

(51) Int. Cl.[7] ..... D01G 15/40
(52) U.S. Cl. ..... 19/105
(58) Field of Search ..... 19/65 A, 105, 19/200, 65 R, 204, 205, 98

(56) References Cited

U.S. PATENT DOCUMENTS

| | | | | | |
|---|---|---|---|---|---|
| 3,709,406 | A | * | 1/1973 | Binder et al. | 406/19 |
| 4,506,413 | A | * | 3/1985 | Leifeld | 19/105 |
| 4,527,306 | A | * | 7/1985 | Thannheiser | 19/66 CC |
| 4,535,511 | A | * | 8/1985 | Leifeld et al. | 19/105 |
| 4,682,388 | A | | 7/1987 | Pinto | |
| 4,709,451 | A | * | 12/1987 | Leifeld | 19/105 |
| 4,723,344 | A | * | 2/1988 | Leifeld | 19/105 |
| 4,731,909 | A | | 3/1988 | Duda | |
| 4,779,311 | A | * | 10/1988 | Leifeld | 19/105 |
| 4,823,440 | A | * | 4/1989 | Pinto | 19/105 |
| 4,940,367 | A | | 7/1990 | Stäheli et al. | |
| 5,247,722 | A | * | 9/1993 | Leifeld | 19/105 |
| 5,815,890 | A | | 10/1998 | Leifeld | |

FOREIGN PATENT DOCUMENTS

| | | |
|---|---|---|
| DE | 37 03 450 | 11/1987 |
| DE | 36 19 248 | 12/1987 |
| DE | 40 38 150 | 8/1991 |
| DE | 41 27 990 | 2/1994 |
| DE | 195 38 496 | 2/1997 |
| DE | 201 02 245 | 5/2001 |
| EP | 0 303 023 | 2/1989 |
| GB | 2 106 668 A | 4/1983 |
| GB | 2 182 365 | 5/1987 |
| GB | 2 344 359 | 6/2000 |
| JP | 09-105026 | 4/1997 |

* cited by examiner

*Primary Examiner*—Gary L. Welch
(74) *Attorney, Agent, or Firm*—Venable LLP; Robert Kinberg; Stuart I. Smith

(57) ABSTRACT

An apparatus for regulating fiber quantities to be supplied to a carding machine. The apparatus includes a duct in which the fiber material is pneumatically advanced; a feed mechanism to advance fiber material to the duct at a variable flow rate; a regulator connected to the feed mechanism for varying the flow rate; a pressure sensor disposed in the duct; an arrangement for generating first electric signals representing actual pressure values detected by the pressure sensor; an arrangement for differentiating the first signals over time to obtain second electric signals for correcting the first electric signals to obtain third electric signals representing corrected actual pressure values; and an arrangement for applying the third signals to the regulator for varying the flow rate of the fiber material, advanced by the feed mechanism, as a function of the signals.

7 Claims, 3 Drawing Sheets

APPARATUS FOR REGULATING FIBER TUFT QUANTITIES SUPPLIED TO A CARDING MACHINE

CROSS REFERENCE TO RELATED APPLICATIONS

This application is a continuation of application Ser. No. 10/021,305 filed Dec. 19, 2001.

This application claims the priority of German Application No. 100 64 655.7 filed Dec. 22, 2000, which is incorporated herein by reference.

BACKGROUND OF THE INVENTION

This invention relates to an apparatus for regulating fiber quantities supplied to at least one carding machine. The apparatus has a pressure measuring member installed in a pneumatic supply and distributor duct upstream of the carding machine. The pressure signals are converted into electric signals (actual pressure magnitudes). The output of the pressure measuring member is coupled via a regulator to a regulated drive of a fiber tuft supply apparatus, such as a fiber cleaner.

European Patent No. 0 303 023, to which corresponds U.S. Pat. No. 4,940,367 describes an arrangement in which the fiber quantities of a card feeder are regulated based on a nominal value/actual value comparison, as a function of which the rpm of an upstream-disposed opener is varied. Because of the fiber quantity already present in the conduit after regulation is initiated (fiber material lag), such a regulating method results in pressure fluctuations in the card supply which, in turn, affect the fiber batt density in the card feeder. To obtain an optimal, uniform batt density, pressure fluctuations should be kept at a minimum. Since the deviation of the pressure from the set nominal pressure is a measure for the deviation of the material intake speed of the opener from a preset mid value, to each pressure value a fixed rpm value is associated. In case of substantial deviations, upon reaching the nominal pressure value based on the above-described material lag, a significantly excessive or insufficient output takes place. As a result, the pressure signal over-regulates and thus the undesired fluctuations take place. In case the number of the carding machines is reduced during operation, for example, by shutting off one of the cards, the supply and distributor duct is shortened which results in an increased static pressure. Such an increased actual pressure value at the pressure measuring member leads to an immediate change of the quantity of the fiber tufts discharged by the cleaner, that is, it leads to a reduction of the fiber quantity feed which is sufficient for the cards that continue to operate. However, the fiber quantities introduced into the conduit before the initiation of regulation (that is, the change of the intake speed of the cleaner) are still in the conduit. It is a disadvantage that such a large tuft quantity leads to a further increase in the static pressure due to the resistance of the fiber material (because of the reduced cross section at the air outlet openings) which, in turn results in a further reduction of the fiber feed quantities below the predetermined value. It is a further drawback that the lag represents an excessive fiber quantity for the cards still operating. The above-discussed problems occur not only upon the stoppage of one of the carding machines but because of the fluctuating fiber quantity requirements by all operating carding machines.

SUMMARY OF THE INVENTION

It is an object of the invention to provide an improved apparatus of the above-outlined type from which the discussed disadvantages are eliminated and which, in particular, makes possible a uniform fiber tuft feed even at substantial deviations of the pressure and/or the fiber quantities due to the changing material requirements by the after-connected carding machines.

This object and others to become apparent as the specification progresses, are accomplished by the invention, according to which, briefly stated, the apparatus for regulating fiber quantities to be supplied to a carding machine includes a duct in which the fiber material is pneumatically advanced; a feed mechanism to advance fiber material to the duct at a variable flow rate; a regulator connected to the feed mechanism for varying the flow rate; a pressure sensor disposed in the duct; an arrangement for generating first electric signals representing actual pressure values detected by the pressure sensor; an arrangement for differentiating the first signals over time to obtain second electric signals for correcting the first electric signals to obtain third electric signals representing corrected actual pressure values; and an arrangement for applying the third signals to the regulator for varying the flow rate of the fiber material, advanced by the feed mechanism, as a function of the signals.

The setting member (that is, the drive for the material intake rolls of the upstream connected cleaner) is set even before a change of pressure in the fiber supply duct occurs. Based on the slope of the pressure curve as a function of time, the increasing, constant or decreasing pressure values (as viewed over time) are "anticipated" and thus the feed of the fiber tufts is accordingly set. The increase of the pressure signal is obtained by a $\Delta p/\Delta t$ differentiation. This increase is used to additionally affect the intake velocity of the opener. The fixed association of the intake velocity with the pressure signal is thus partially discontinued since in case of increasing pressures a smaller intake speed is assigned than in case of dropping pressures. The momentary pressure value thus does not by itself predetermine the intake velocity. In this manner a damping of the pressure signal may be obtained.

DESCRIPTION OF THE PREFERRED EMBODIMENTS

Figure 1:
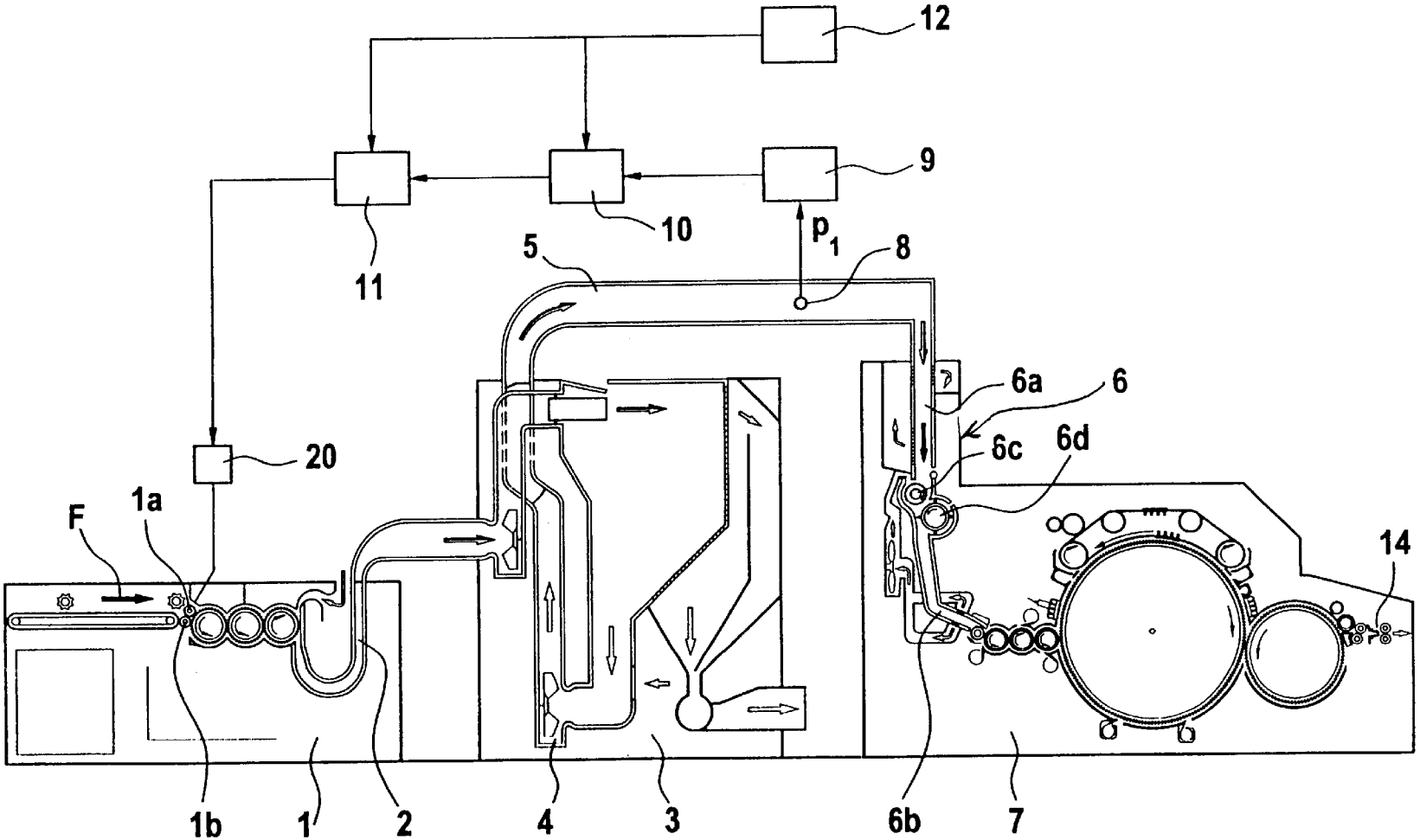
FIG. 1 is a schematic side elevational view of a fiber preparation line including a block diagram of the apparatus according to the invention.

FIG. 1 shows a spinning preparation line in which the fiber material F is introduced from a bale opener and a mixer (neither is shown) to a cleaner 1. From the last roll of the cleaner 1, the opened and cleaned fiber material is pneumatically delivered through a duct 2, a de-dusting machine 3, a fan 4 and a pneumatic supply and distributor duct 5 to a tuft feeder 6. The tuft feeder 6 produces a fiber batt from the fiber tufts and introduces the fiber batt in a carding machine 7. The cleaner 1, the de-dusting machine 3, the card feeder 6 and the carding machine 7 may be, respectively, a CVT 3 model, a DUSTEX DX model, a DIRECTFEED DFK model and a high-performance DK 903 model, all manufactured by Trützschler GmbH & Co. KG, Mönchengladbach, Germany.

In a wall of the supply and distributor duct 5 a pressure sensor 8 is disposed whose static-pressure signals are applied to a transducer 9 which converts the pressure signals into electric signals. The latter are applied to a control device 10, such as a computer. In the control device 10 an electric signal for the corrected actual pressure value is generated by means of a $\Delta p/\Delta t$ differentiation and applied to an electronic regulating device 11. Further, an inputting device 12 for a nominal pressure value is provided which is connected to the control device 10 and the regulator 11. The regulator 11 applies its electric setting signals to a drive 20 such as a regulated electric motor which, in turn, drives intake rolls 1*a*, 1*b* of the cleaning device 1.

Figure 2:
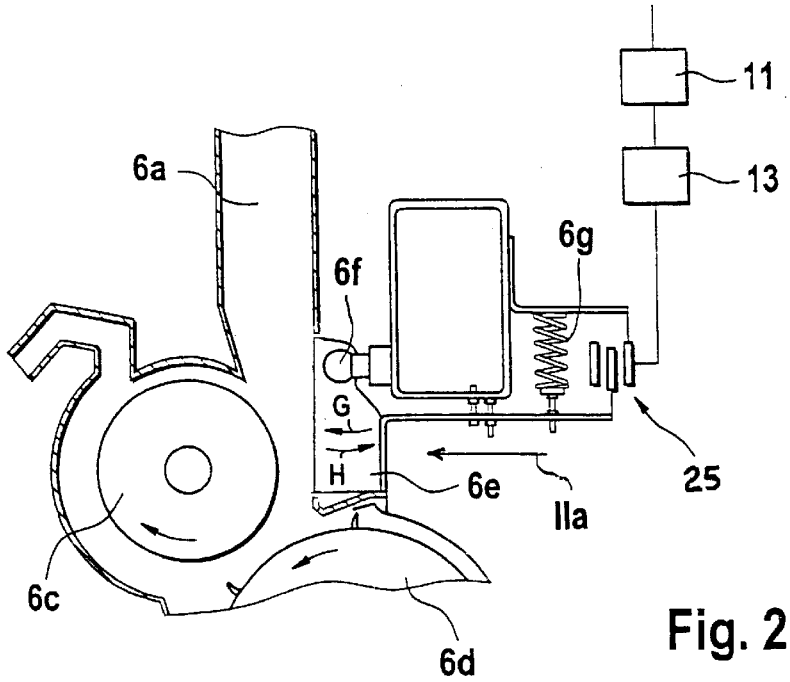
FIG. 2 is a schematic sectional side elevational view of one part of a fiber tuft feeder including regulated feed tray segments.
Figure 2A:
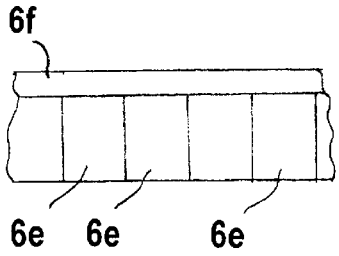
FIG. 2*a* is a schematic front elevation of a part of the FIG. 2 structure taken in the direction of the arrow IIa, illustrating the tray segments.

As further shown in FIG. 1, and also referring to FIGS. 2 and 2*a*, the fiber tuft feeder 6 has an upper, reserve chute 6*a* and a lower, feed chute 6*b* between which a fiber tuft delivering device is arranged. The fiber tuft delivering device is composed of a slowly rotating intake roll 6*c* and a rapidly rotating opening roll 6*d*. The intake roll 6*c* cooperates with a feed tray composed of feed tray segments 6*e* which extend over the width of the tuft feeder 6. The segments 6*e* are rotatable in the direction of arrows G,H about a joint 6*f* against the force of a resetting spring 6*g*. The tray segments 6*e* are coupled to an inductive displacement sensor 25 which is connected via a computer 13 to the regulator 11. In this manner changes in the mass of the delivered fiber material are detected and converted to electric signals.

Figure 3:
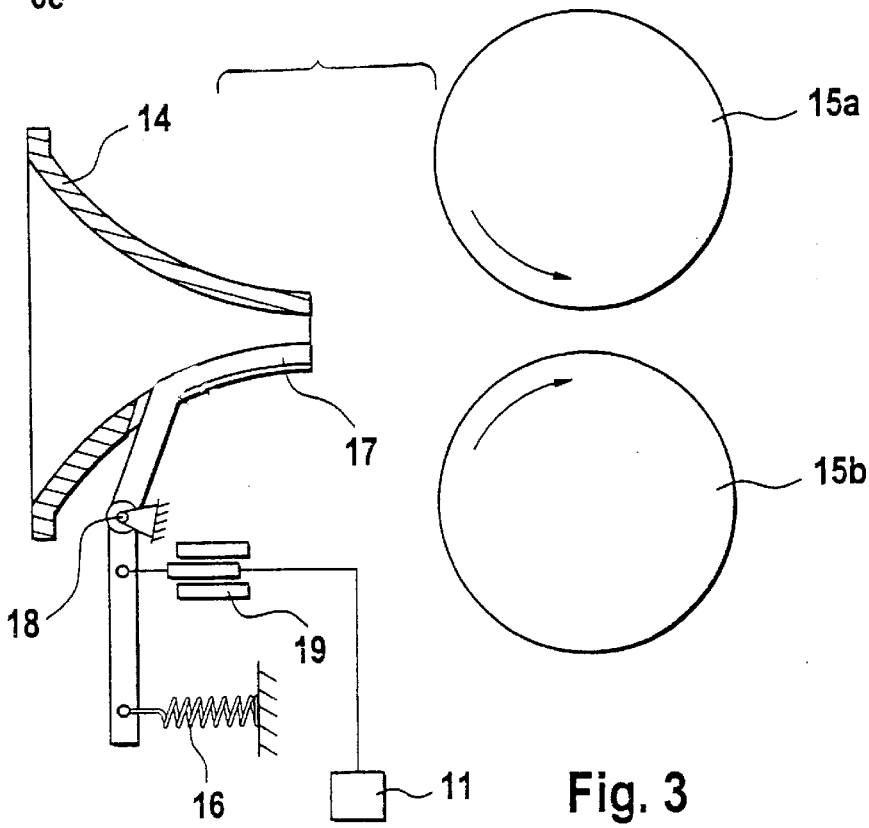
FIG. 3 is a schematic sectional side elevational view of a sliver trumpet including a sliver thickness measuring device.

As further shown in FIGS. 1 and 3, at the output end of the carding machine 7 a sliver trumpet 14 is disposed, followed by two calender rolls 15*a*, 15*b*. The sliver trumpet 14 has a sensor member 17 biased by a spring 16 and rotatable about a joint 18. The sensor member 17 cooperates with an inductive displacement sensor 19 which is connected to the regulator 11. By virtue of this arrangement, sliver thickness variations are detected and converted into electric signals.

Figure 4:
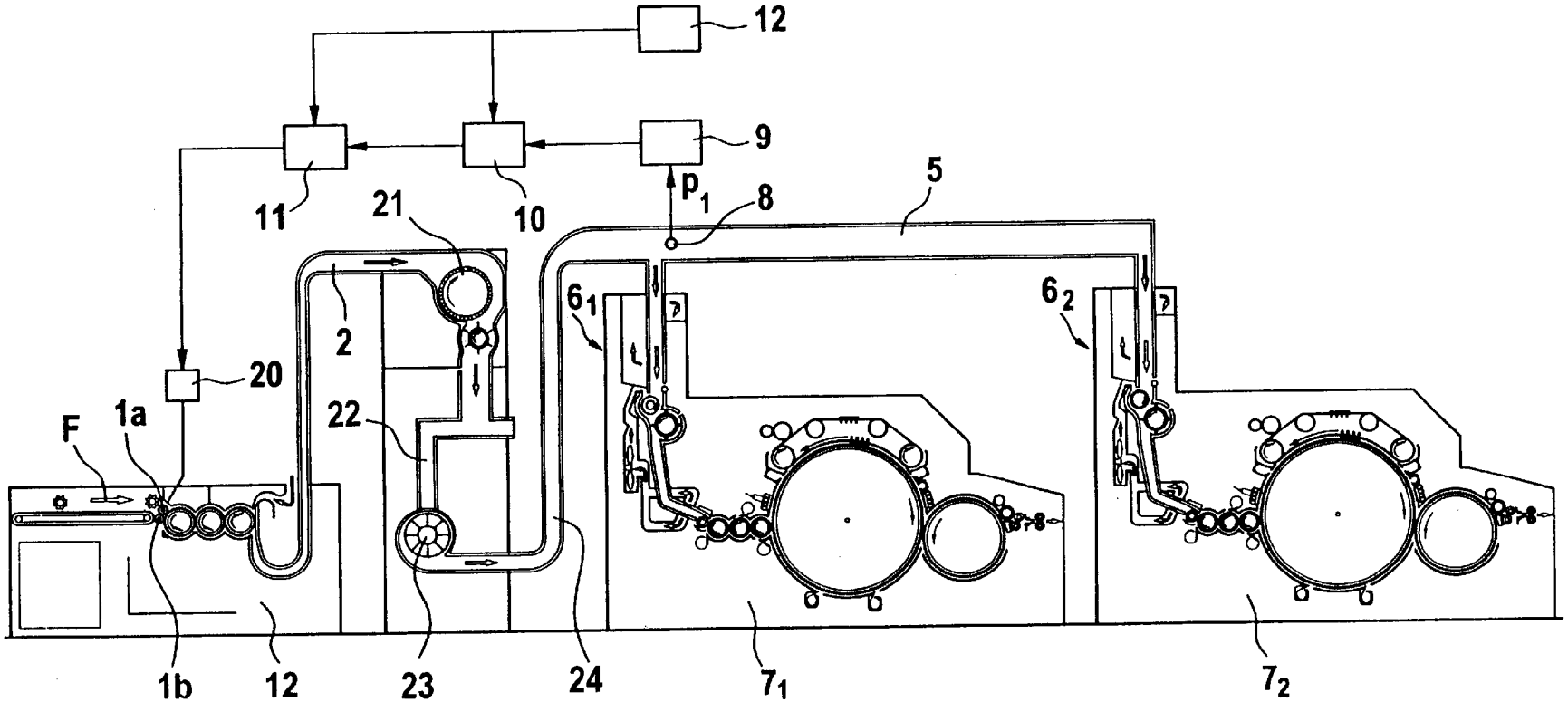
FIG. 4 is a system similar to FIG. 1, including an additional carding machine.

The fiber preparation line illustrated in FIG. 4 shows a cleaning apparatus 12 which may be a CLEANOMAT CVT 4 model, manufactured by Trützschler GmbH & Co. KG, followed by a pneumatic duct 2, a condenser 21, a feed chute 22 and a transport fan 23 which drives the fiber tufts through a duct 24 and the supply and distributor duct 5 into two tuft feeders $\mathbf{6}_1$ and $\mathbf{6}_2$ coupled to two carding machines $\mathbf{7}_1$ and $\mathbf{7}_2$, respectively.

The pressure sensor 8 is connected via the transducer 9 and the control device 10 (such as a computer) with the regulator 11 to which a nominal value setting device 12 is connected. The regulator 11 applies its signals to the drive 20 for the intake rolls 1*a*, 1*b* of the cleaner 12.

It will be understood that the above description of the present invention is susceptible to various modifications, changes and adaptations, and the same are intended to be comprehended within the meaning and range of equivalents of the appended claims.

What is claimed is:

1. A combination of a carding machine with an apparatus for regulating fiber quantities to be supplied to said carding machine; the apparatus comprising:

(a) a duct for guiding the fiber material therein;

(b) means for pneumatically advancing the fiber material in said duct;

(c) a feed mechanism to advance fiber material to said duct at a variable flow rate;

(d) a regulator connected to said feed mechanism for varying the flow rate;

(e) a pressure sensor disposed in said duct;

(f) means for generating a plurality of first electric signals representing actual pressure values detected by said pressure sensor;

(g) means for generating a second electric signal for correcting a selected one of the first electric signals to obtain a third electric signal representing a corrected actual pressure value, the second electric signal representing a rate of change between the selected first electric signal and an immediately following one of the first electric signals; and (h) means for applying said third signals to said regulator for varying the flow rate of the fiber material, advanced by said feed mechanism, as a function of said third signals.

2. The combination as defined in claim 1, wherein said apparatus comprises a fiber cleaner and wherein said feed mechanism comprise an intake roll of said cleaner.

3. The combination as defined in claim 1, further comprising a nominal value setter connected to said regulator for inputting nominal pressure values.

4. The combination as defined in claim 1, wherein said pressure sensor is arranged for detecting static pressure in said duct.

5. The combination as defined in claim 1, wherein said carding machine includes a sliver trumpet disposed at an output of said carding machine; said sliver trumpet including a sliver thickness sensor arrangement emitting fourth electric signals representing thickness fluctuations of the sliver passing through said sliver trumpet; and means for applying said fourth electric signals to said regulator.

6. The combination as defined in claim 1, in combination with a fiber tuft feeder comprising (a) an upper chute connected to an output of said duct for receiving fiber tufts from said duct;

(b) a lower chute adjoining said upper chute; said lower chute having an output connected to an input of said carding machine;

(c) a feed roll disposed between said upper and lower chutes for advancing the fiber tufts from said upper chute to said lower chute;

(d) a movable feed tray cooperating with said feed roll and executing excursions in response to and as a function of thickness fluctuations of the fiber tufts passing between said feed roll and said feed tray; and (e) means for converting the excursions into fourth electric signals and for applying the fourth electric signals to said regulator.

7. The combination as defined in claim 6, wherein said feed tray is composed of separately movable feed tray segments.

* * * * *